US008381796B2

(12) United States Patent
Tomes, Jr. et al.

(10) Patent No.: US 8,381,796 B2
(45) Date of Patent: Feb. 26, 2013

(54) FUNCTIONALLY GRADED METAL MATRIX COMPOSITE SHEET

(75) Inventors: David A. Tomes, Jr., Sparks, NV (US); Gavin F. Wyatt-Mair, Lafayette, CA (US); David W. Timmons, Reno, NV (US); Ali Unal, Export, PA (US)

(73) Assignee: ALCOA Inc., Pittsburgh, PA (US)

( * ) Notice: Subject to any disclaimer, the term of this patent is extended or adjusted under 35 U.S.C. 154(b) by 0 days.

(21) Appl. No.: 12/913,999

(22) Filed: Oct. 28, 2010

(65) Prior Publication Data

US 2011/0042032 A1 Feb. 24, 2011

Related U.S. Application Data

(62) Division of application No. 11/734,121, filed on Apr. 11, 2007, now Pat. No. 7,846,554.

(51) Int. Cl.
*B22D 11/06* (2006.01)
*B22D 19/14* (2006.01)

(52) U.S. Cl. ..... 164/461; 164/480; 164/97

(58) Field of Classification Search ..... 164/461, 164/480, 97

See application file for complete search history.

(56) References Cited

U.S. PATENT DOCUMENTS

| | | | |
|---|---|---|---|
| 2,693,012 | A | 11/1954 | Harris et al. |
| 3,078,563 | A | 2/1963 | Gould et al. |
| 3,167,830 | A | 2/1965 | Hazellet et al. |
| 3,232,796 | A | 2/1966 | Anderson et al. |
| 3,346,370 | A | 10/1967 | Jagaciak et al. |
| 3,346,371 | A | 10/1967 | Jagaciak et al. |
| 3,346,372 | A | 10/1967 | Jagaciak et al. |
| 3,346,373 | A | 10/1967 | Jagaciak et al. |
| 3,346,374 | A | 10/1967 | Jagaciak et al. |
| 3,346,375 | A | 10/1967 | Jagaciak et al. |
| 3,346,376 | A | 10/1967 | Jagaciak et al. |
| 3,346,377 | A | 10/1967 | Jagaciak et al. |
| 3,366,476 | A | 1/1968 | Jagaciak et al. |
| 3,490,955 | A | 1/1970 | Winter et al. |
| 3,556,872 | A | 1/1971 | Jagaciak et al. |
| 3,582,406 | A | 6/1971 | Ford et al. |
| 3,617,395 | A | 11/1971 | Ford |

(Continued)

FOREIGN PATENT DOCUMENTS

| | | |
|---|---|---|
| AU | 2005214348 | 9/2011 |
| CA | 2557417 | 3/2010 |

(Continued)

OTHER PUBLICATIONS

U.S. Patent and Trademark Office; Final Office Action Issued Against U.S. Appl. No. 12/913,972; Mar. 9, 2012; 11 pages; U.S.A.

(Continued)

*Primary Examiner* — Kevin P Kerns
(74) *Attorney, Agent, or Firm* — Greenberg Traurig, LLP

(57) ABSTRACT

A method of making a functionally graded metal matrix composite (MMC) sheet having a central layer of particulate matter, the particulate matter having a size of at least about 30 microns. The method includes providing a molten metal containing particulate matter to a pair of advancing casting surfaces. Solidifying the molten metal while advancing the molten metal between the advancing casting surfaces to form a first solid outer layer, a second solid outer layer, and a semi-solid central layer having a higher concentration of particulate matter than either of the outer layers. Solidifying the central layer to form a solid metal product including a central layer sandwiched between the outer layers and withdrawing the metal product from between the casting surfaces.

10 Claims, 5 Drawing Sheets

U.S. PATENT DOCUMENTS 3,708,352 A 1/1973 Brown et al.
3,761,322 A 9/1973 Winter et al.
3,831,323 A 8/1974 Widner et al.
4,002,197 A 1/1977 Hazelett et al.
4,098,957 A 7/1978 Vernam et al.
4,146,163 A 3/1979 Anderson et al.
4,146,164 A 3/1979 Anderson et al.
4,151,013 A 4/1979 Thompson et al.
4,161,553 A 7/1979 Vernam et al.
4,235,646 A 11/1980 Neufeld et al.
4,238,248 A 12/1980 Gyongyos et al.
4,260,419 A 4/1981 Robertson
4,282,044 A 8/1981 Robertson et al.
4,341,261 A 7/1982 Thomas et al.
4,356,618 A 11/1982 Jordan
4,484,614 A 11/1984 Maringer
4,626,294 A 12/1986 Sanders, Jr.
4,751,958 A 6/1988 Flowers et al.
4,782,994 A 11/1988 Raybould et al.
4,823,860 A 4/1989 Lauener
4,828,008 A 5/1989 White et al.
4,828,012 A 5/1989 Honeycutt, III et al.
4,915,158 A 4/1990 Allyn et al.
4,996,025 A 2/1991 Pratt et al.
5,015,766 A 5/1991 Kambara et al.
5,047,369 A 9/1991 Fleming et al.
5,053,286 A 10/1991 Pratt et al.
5,106,429 A 4/1992 McAuliffe et al.
5,125,452 A 6/1992 Yamauchi et al.
5,181,969 A 1/1993 Komatsubara et al.
5,333,672 A 8/1994 Gelfgat et al.
5,356,495 A 10/1994 Wyatt-Mair et al.
5,362,523 A 11/1994 Gorynin et al.
5,365,664 A 11/1994 Whitney, Jr.
5,370,171 A 12/1994 Fields et al.
5,400,851 A 3/1995 Prinz et al.
5,423,925 A 6/1995 Shoji et al.
5,470,405 A 11/1995 Wyatt-Mair et al.
5,482,107 A 1/1996 Judd
5,496,423 A 3/1996 Wyatt-Mair et al.
5,514,228 A 5/1996 Wyatt-Mair et al.
5,515,908 A 5/1996 Harrington
5,518,064 A 5/1996 Romanowski et al.
5,536,587 A 7/1996 Whitney, Jr.
5,564,491 A 10/1996 Harrington
5,585,067 A 12/1996 Leroy
5,588,478 A 12/1996 Jin et al.
5,655,593 A 8/1997 Wyatt-Mair et al.
5,728,241 A 3/1998 Gupta et al.
5,742,993 A 4/1998 Sun
5,769,972 A 6/1998 Sun et al.
5,772,799 A 6/1998 Sun et al.
5,772,802 A 6/1998 Sun et al.
5,785,777 A 7/1998 Cantrell et al.
5,833,775 A 11/1998 Newton et al.
5,862,582 A 1/1999 Sun
5,894,879 A 4/1999 Wyatt-Mair et al.
5,934,359 A 8/1999 Strezov
5,942,057 A 8/1999 Hanamura et al.
5,979,538 A 11/1999 Braun et al.
5,983,980 A 11/1999 Freeman et al.
6,044,896 A 4/2000 Harrington
RE36,692 E 5/2000 Gupta et al.
6,056,835 A 5/2000 Miyake et al.
6,063,215 A 5/2000 Harrington
6,082,659 A 7/2000 Sankaran et al.
6,102,102 A 8/2000 Harrington
6,110,604 A 8/2000 Rickerby
6,120,621 A 9/2000 Jin et al.
6,135,199 A 10/2000 Wyatt-Mair
6,146,477 A 11/2000 Clark et al.
6,193,818 B1 2/2001 Legresy et al.
6,221,515 B1 4/2001 Ramos Junior et al.
6,238,497 B1 5/2001 Jin et al.
6,248,193 B1 6/2001 Zhao et al.
6,264,765 B1 7/2001 Bryant et al.
6,264,769 B1 7/2001 Benedetti
6,273,970 B1 8/2001 Kopeliovich et al.
6,280,543 B1 8/2001 Zonker et al.
6,316,061 B1 11/2001 Andler et al.
6,328,823 B1 12/2001 Deicke et al.
6,336,980 B1 1/2002 Benedetti
6,344,096 B1 2/2002 Baumann et al.
6,391,127 B1 5/2002 Wyatt-Mair et al.
6,423,164 B1 7/2002 Bryant et al.
6,537,392 B2 3/2003 Magnusen et al.
6,543,122 B1 4/2003 Perkins et al.
6,581,675 B1 6/2003 Harrington
6,596,671 B2 7/2003 Whitney, Jr. et al.
6,602,363 B2 8/2003 Ren
6,623,797 B2 9/2003 Avalos
6,672,368 B2 1/2004 Unal
6,681,838 B2 1/2004 Chi et al.
6,833,339 B2 12/2004 Whitney, Jr. et al.
6,880,617 B2 4/2005 Wyatt-Mair et al.
6,959,476 B2 11/2005 Li et al.
7,089,993 B2 8/2006 Wyatt-Mair et al.
7,125,612 B2 10/2006 Unal
7,182,825 B2 2/2007 Unal
7,211,161 B2 5/2007 Pillet et
7,503,378 B2 3/2009 Unal
7,846,554 B2 * 12/2010 Tomes et al. ..... 428/548
2002/0031658 A1 3/2002 Chow et al.
2002/0153123 A1 10/2002 Unal
2002/0167005 A1 11/2002 Yu et al.
2003/0015309 A1 1/2003 Bouchard et al.
2003/0205357 A1 * 11/2003 Unal ..... 164/480
2004/0007295 A1 1/2004 Lorentzen et al.
2004/0035505 A1 2/2004 Uanl et al.
2004/0079455 A1 4/2004 Dif et al.
2005/0183801 A1 8/2005 Unal et al.
2005/0211350 A1 9/2005 Unal et al.
2006/0213590 A1 9/2006 Danielou et al.
2007/0000637 A1 1/2007 Wyatt-Mair et al.
2007/0095499 A1 5/2007 Tomes, Jr. et al.
2007/0137830 A1 6/2007 Unal
2008/0251230 A1 10/2008 Tomes et al.
2008/0254309 A1 10/2008 Tomes et al.
2010/0084053 A1 4/2010 Thomes et al.
2011/0036464 A1 2/2011 Tomes et al.
2011/0042032 A1 2/2011 Tomes et al.

FOREIGN PATENT DOCUMENTS

CN 1942595 A 4/2007
CN 1997763 A 7/2007
CN 101039802 A 9/2007
CN 101678440 3/2010
CN 101678444 3/2010
CN 102264930 A 11/2011
EP 0321152 6/1989
EP 0440275 8/1991
EP 0291505 10/1992
EP 0576170 A1 12/1993
EP 0576171 A1 12/1993
EP 0605947 A1 7/1994
EP 0610006 8/1994
EP 0576170 B1 3/2000
EP 0851943 B1 5/2003
EP 2142324 1/2010
EP 1733064 B1 7/2010
EP 2264198 12/2010
EP 2347023 A1 7/2011
JP 50117663 9/1975
JP 51089827 8/1976
JP 6027450 2/1985
JP 61276751 12/1986
JP 626742 1/1987
JP 644458 1/1989
JP 1202344 8/1989
JP 01242762 9/1989
JP 05277656 10/1993
JP 06071303 3/1994
JP 7148557 6/1995
JP 2000501995 2/2000
JP 11511389 8/2004
JP 2005504635 2/2005
JP 4355342 8/2009

| | | | |
|---|---|---|---|
| KR | 100861563 | | 9/2008 |
| KR | 10-1156956 | | 6/2012 |
| RU | 2139953 | C1 | 10/1999 |
| RU | 2356998 | C2 | 2/2005 |
| RU | 2284364 | | 2/2006 |
| RU | 2008121915 | | 12/2009 |
| SU | 1453932 | | 3/1996 |
| WO | WO 91/00933 | | 1/1991 |
| WO | WO 93/22086 | | 11/1993 |
| WO | WO 94/10351 | | 5/1994 |
| WO | WO 94/10351 | A1 * | 5/1994 |
| WO | WO 94/13472 | | 6/1994 |
| WO | WO 96/27031 | | 9/1996 |
| WO | WO 97/11205 | | 3/1997 |
| WO | WO 97/14520 | | 4/1997 |
| WO | WO 98/45492 | | 10/1998 |
| WO | WO 99/42628 | | 8/1999 |
| WO | WO 02/066181 | A2 | 8/2002 |
| WO | WO 2004/018124 | | 3/2004 |
| WO | WO 2005/080619 | A1 | 9/2005 |
| WO | WO 2006/124045 | A2 | 11/2006 |
| WO | WO 2008/128055 | | 10/2008 |
| WO | WO 2008/128061 | | 10/2008 |
| WO | WO 2010/042604 | A1 | 4/2010 |
| WO | WO 2010/053675 | | 5/2010 |

OTHER PUBLICATIONS

Japanese Patent Office; Notice of Reasons for Refual Issued Against Japanese Application No. 2010-503236; Mar. 13, 2012; 8 pages; Japan.
European Patent Office; Office Action Issued Against European Applicaiton No. 03737080.6; Mar. 16, 2012; 5 pages; Europe.
Japanese Patent Office; Notice of Reasons for Refusal Issued Against Japanese Application No. 2010-503238; Mar. 27, 2012; 9 pages; Japan.
Hee-Kyung Moonet al., Development of Strip Casting Process at POSCO/RIST; pp. 1-6, Research Institute fo industrial Science & Technology, Repulic of Korea.
Randall J. Frick, The Kaiser Can Stock Micromill Process, Kaiser Aluminum and Chemical Corp.; pp. 447-449.
Donald G. Harrington et al., The Keiser Caster-Description and Status, Kaiser Aluminum & Chemical Corp.; pp. 450-457.
P. Griffiths et al., Metal Matrix Composite Sheet Produced by Twin-Roll Casting; Process and Properties of Materials; pp. 207-2212; Department of Materials; University of Oxford, Oxford.
X.Yang et al.; A Quantitative Study of Grain Structure in Twin-Roll Cast Aluminum Alloys, Part I: AA 1070; Forschung; pp. 65-70; Oxford.
X. Yang et al.; A Quantitative Study of Grain Structures in Twin-Roll Cast Aluminum Alloys, Part II: AA 3004; Forschung; 3 pages; Oxford.
Standard Test Method for Determining the Susceptibility to Intergranular Corrosion of 5XXX Series Aluminum Alloys by Mass Loss After Expposure to nitric Acid (NAMLT TEST); Designation: G 67-86; pp. 247-248; The American Society for Testing and Materials; USA.
Standard Practice for Evaluating Stress Corrosion Cracking Resistance of Metals and Alloys by Alternate Immersion in 3.5% Sodium Chloride Solution; pp. 162-165; USA.
Philip Thomas; Chapter 2: Continuous Casting of Aluminum Alloys; pp. 26-47.
Cast Aluminum Alloys Designation System; Aluminum Alloy and Temper Designation Systems of the Aluminum Association; pp. 11 and 16-19.
Von Otto Dahl et al.; Uber Die Aushartung von Aluminum-Magnesium-Legierungen; Zeitschrift Fur Metallkunde; 46 Jajrgang 1955; pp. 94-99.
Ernest S. Hedges et al.; Tin and Its Alloys; 1960; pp. 282-295; Edward Arnold (Publishers) Ltd,; Great Britain.
Taylor Lyman et al.; Heat Treating, Cleaning and Finishing; Metals Handbook; 1964; pp. 277-278; vol. 2, 8th Edition; American Society for Metals; USA.
Mark G. Fontana et al.; Advances in Corrosion Science and Technology; 1972; pp. 210-223; vol. 2, Plenum Press; England.
Ryoichi Nozato et al.; Calorimetric Study of Precipitation Process in Al-Mg Alloys; Transactions of the Japan Institute of Metals; 1980; pp. 580-588; vol. XXI; The Japan Institute of Metals; Japan.
I.Jin et al.; Centre Line Segragation in Twin Roll Cast Aluminum Alloy Slab; Light Metals 1982; Feb. 14, 1982; pp. 873-888; The Metallurgical Society of AIME; USA.
Anne Lise Dons, AlFeSi-Particles in Industrially Cast Aluminum Alloys; Jan. 30, 1985; pp. 609-613; Department of Metallurgy, Norway.
Patent Abstracts of Japan for Japanese Publication 60-027450; http://www19.ipdl.inpit.go.jp/PA1/result/detail/main/wAAAWpaqE2DA360027450 . . . , Feb. 12, 1985, 1 page.
Patent Abstracts of Japan for Japanese Publication 61-276751; http://www19.ipdl.inpit.go.jp/PA1/result/detail/main/wAAWpaqE2DA361276751....; Dec. 6, 1986; 1page.
Patent Abstracts of Japan for Japanese Publication 62-006742; http://www19.ipdlinpit.go.jp/PA1/result/main/wAAAWpaqE2DA3620067422....; Jan. 13, 1987; 1 page.
Patent Abstracts of Japan for Japanese Publication 64-004458; http://www19.ipdl.inpit.go.jp/PA1/result/detail/main/wAAAWpaqE2DA364004458....; Jan. 9, 1989; 1 page.
Patent Abstracts of Japan for Japanese Publication 01-202344; http://www19.ipdl.inpit.go.jp/PA1/result/detail/main/wAAACGaqhoDA401202344P1.htm; Aug. 15, 1989; 6 pages.
Patent Abstracts of Japan for Japanese Publication 01-242762; http://www19.ipdl.inpit.go.jp/PA1/result/detail/main/wAAAo_aq3fDA401242762P1.htm; Sep. 27, 1989, 1 page.
J. Masounave et al.; The Design and Implementation of the IMRI Strip Caster; 1988; pp. 473-492; The Metallurgial Society.
Manabu Nakai et al.; Influence of Additional Elements on the Resistance to Stress Corrosion Cracking of Al-Mg Alloys; 1991; pp. 419-424; The Japan Institute of Light Metals; Japan.
Wojtek Szczypiorski et al.; The Mechanical and Metallurgical Characteristics of Twin-Belt Cast Aluminum Strip Using Current Hazelett Technology; The Minerals, Metals & Materials Society; 1991; pp. 805-814.
Joseph R. Davis et al.; vol. 4 Heat Treating; ASM Handbook; Aug. 1991; pp. 851-857 and 878-879; ASM International; USA.
L. Amberg et al.; Aluminum Alloys—Their Physical and Mechanical Properties; Jun. 1992; pp. 20-27; vol. 1; The Norwegian Institute of Technology; Norway.
Aluminum Standards and Data 1993; Table 3.5—Typical Annealing Treatments for Aluminum Alloy Mill Products; 1993; 2 pages; The Aluminum Association Incorportated.
Patent Abstracts of Japan for Japanese Publication 05-277656; http://www19.ipdl.inpit.go.jp/PA1/result/detail/main/wAAAWpaqE2DA405277656....; Oct. 26, 1993; 1 page.
Patent Abstract of Japan for Japanese Publication 06-071303; http://www19.ipdl.inpit.go.jp/PA1/result/detail/main/wAAAySa4DBDA406071303P1....; Mar. 15, 1994; 1 page.
Pan Fusheng et al.; The SIC Distribution in the As-Cast Strips of SICP/A356 Aluminum Matrix Composites by the Twin Roll Casting; Acta Materials Composite Sinica; Feb. 1995; 9 pages; vol. 12, No. 1; Chongqing University; China.
Patent Abstracts of Japan for Japanese Publication 07-148557; http://www19.ipdl.inpit.go.jp/PA1/result/detail/main/wAAAWpaqE2DA407148557....; Jun. 13, 1995; 1 page.
P.A. Karnezis et al.; Mechanical Properties and Microstructure of Twin Roll Cast Al-7Si/SiCp MMCs; Materials Science and Technology; Aug. 1995; pp. 741-751; vol. 11; University of Pittsburgh, PA.
Yoshihiro Nakayama et al.; Precipitation Behaviors of B-Phase and Changes in Mechanical Properties of AL-MG System Alloys; 1996; pp. 1269-1274; Transtec Publications Ltd.; Switzerland.
P.A. Karnezis et al.; Effect of Processing on the Microstructure and Tensile Properties of A356/SiCp MMCs; Materials Science Form vols. 217-222; 1996; pp. 341-346 Transtec Publications; Switzerland.
SU 1453932 A1, Abstract of Invention for Application No. 4193818/02; Mar. 27, 1996; 1 page.
P.A. Karnezis et al.; Characterization of Reinforcement Distribution in Cast Al-Alloy/ SiCp Composites; Materials Characterizations; Apr. 1997; pp. 97-109; Elsevier Science Inc.; USA.

Keitarou Yamaguchi et al.; Effect of Zn Addition on Intergranular Corrosion Resistance of Al-Mg-Si-Cu Alloys; Aluminum Alloys, Their Pysical and Mechanical Properties; 1998; pp. 1657-1662; vol. 3; The Japan Institute of Light Metals; Japan.
Toshio Haga et al.; High Speed Roll Caster for Aluminum Alloy Strip; Aluminum Alloys; vol. 1; pp. 327-332; Osaka Institute of Technology; Japan.
T. Sheppard; 4.13 Press Quenching and Press Solutionizing, Extrusion of Aluminum Alloys; 1999; pp. 186-191; Kluwer Academic Publishers; The Netherlands.
J.Z. Zhao; XP-002482794; Strip Casting of Al-Pb Alloys—A Numerical Analysis; Materials Science & Engineering A282; Sep. 20, 1999; pp. 262-269; Elsevier Science S.A.; Germany.
Toshio Haga et al.; High-Speed Roll Caster for Strip Casting of Aluminm Alloy; Meterials Science Forum; vols. 331-337; 2000; pp. 185-190; Trans Tech Publications; Switzerland.
E.S. Puchi-Cabrera; Modeling Cold-Rolling Process of Commercial Twin Roll Cast Aluminum Alloys; Sep. 14, 2000; 1 page; Universidad Central de Venezuela; Venzuela.
D. Tomes et al.; Properties of O, T4 adn T6 Temper Products Manufactured In-Line at Alcoa Micromill; Dec. 12, 2002; 11 pages; Alcoa Inc.
U.S. Patent and Trademark Office; Office Action Issued Against U.S. Appl. No. 10/078,638; Mar. 18, 2003; 4 pages; USA.
D. Tomes et al.; Properties of 6061 Sheet, Heat Treatable In-Line at Alcoa Micromill; Jun. 2, 2003; 8 pages; Alcoa Inc.
D.A. Tomes et al.; Properties of Alloy AX-07 in O-Temper Annealed in Line at Alcoa Micromill; Jul. 15, 2003; 23 pages; Alcoa Inc.
D.A. Tomes et al.; Properties of Heat Treatable 6022 Sheet Made In-Line at Alcoa Micromill; Sep. 18, 2003; 26 pages; Alcoa Inc.
Patent Cooperation Treaty; PCT International Search Report Issued in Connection with International Application No. PCT/US03/18764; Sep. 29, 2003; 2 pages; Europe.
Ali Unal et al.; Properties of Al-10%Mg Alloy Sheet Made from Alcoa Micromill Strip; Jan. 22, 2004; 45 pages; Alcoa Inc.
U.S. Patent and Trademark Office; Office Action Issued Against U.S. Appl. No. 10/461,704; Jun. 18, 2004; 4 pages; USA.
Patent Cooperation Treaty; PCT Written Opinion Issued in Connection with International Application No. PCT/US03/18764; Jul. 1, 2004; 4 pages; Europe.
U.S. Patent and Trademark Office; Office Action Issued Against U.S. Appl. No. 10/782,027; Sep. 17, 2004; 11 pages; USA.
Patent Cooperation Treaty; PCT International Preliminary Examinatinon Report Issued in Connection with PCT/US03/18764; Oct. 5, 2004; 3 pages; Europe.
U.S. Patent and Trademark Office; Office Action Issued Againt U.S. Appl. No. 10/461,704; Oct. 28, 2004; 7 pages; USA.
Hirosuke Inagaki; Precipitation of the B -Phase in Al-Mg Alloys; 2005; pp. 45-53; Shonan Institute of Technology; Japan.
Ali Unal; Declaration Under 37 C.F.R. 1.132, Filed in Connection with U.S. Appl. No. 10/461,704; Jan. 20, 2005; 12 pages.
Gaute Svenningson et al.; Effect of Artificial Aging on Intergranualr Corrosion of Extruded AlMgSi Alloy with Small Cu Content; Jan. 25, 2005; pp. 1528-1543; Elsevier Ltd.; Norway.
U.S. Patent and Trademark Office; Notice of Non-Compliant Amendment Issued in Connection with U.S. Appl. No. 10/782,027; Feb. 4, 2005; 2 pages; USA.
Ali Unal et al.; Microstructure of Al-6Sn Alloy Strip Cast in Alcoa Micromill; May 13, 2005; 31 pages; Alcoa Inc.
U.S. Patent and Trademark Office; Final Office Action Issued Against U.S. Appl. No. 10/782,027; Jun. 2, 2005; 13 pages; USA.
U.S. Patent and Tradmark Office; Advisory Action Before the Filing of an Appeal Brief Issued Againt U.S. Appl. No. 10/782,027; Sep. 29, 2005; 8 pages; USA.
Patent Cooperation Treaty; PCT International Preliminary Report on Patentability Issued in Connection with International Application No. PCT/US05/04558; Jan. 18, 2006; 6 pages; Europe.
European Patent Office; Supplementary European Search Report Issued in Connection with EP 03737080; Feb. 3, 2006; 2 pages; Europe.
Patent Cooperation Treaty; PCT International Perliminary Report on Patentability Issued in Connection with International Application No. PCT/US05/04558; Jan. 18, 2006; 6 pages; Europe.
U.S. Patent and Trademark Office; Office Action Issued Against U.S. Appl. No. 10/782,027; Feb. 21, 2006, 12 pages; USA.
RU 2284364 C2; Abstract of Invention for Russian Application No. 2004116858/02; Feb. 27, 2006; 1 page.
European Patent Office; European Office Action Issued Against European Patent Application No. 02706344.5; Sep. 19, 2006; 4 pages; Europe.
Patent Abstracts for Japanese Application No. 63-023717; http://www19.ipdl.ncipi.go.jp/PA1/result/detail/main/wAAACGaqhoDA401202344P1.htm; 2 pages; Website Printed Oct. 3, 2006.
Ali Unal et al.; Alcoa Micromill Caster (AMC): Structure and Properties of AA 5052 Strip Cast at 63 mm tip Setback; Nov. 2006; 51 pages; Alcoa Inc.
European Patent Office; European Office Action Issued Against European Application No. 02706344.5; May 3, 2007; 3 pages; Europe.
European Patent Office; European Office Action Issued in Connection with European Application No. 03737080.6; Jun. 26, 2007; 3 pages; Europe.
Patent Cooperation Treaty; PCT International Search Report Issued in Connection with International Application No. PCT/US05/28353; Aug. 27, 2007; 2 pages; Europe.
Patent Cooperation Treaty; PCT Written Opinion of the International Searching Authority Issued in Connection with International Application No. PCT/US05/28353; Aug. 27, 2007; 6 pages; Europe.
European Patent Office; European Office Action Issued Against European Application No. 02706344.5; Sep. 19 2006; 4 pages; Euorpe.
Patent Abstracts of Japan for Japanese Patent Applicaiton No. 63-023717; http://www19.ipdl.ncipi.go.jp/PA1/result/detail/main/wAAACGaqhoDA401202344P1.htm; 2 pages; website printed Oct. 3, 2006.
Japan Patent Office; Notification of Reason for Refusal Issued Against Japanese Application No. 2002-565730; Nov. 20, 2007; 4 pages; Japan.
European Patent Office; European Office Action Issued Against European Application No. 02706344.5; Dec. 14, 2007; 2 pages; Europe.
The Patent Office of the People's Republic of China; Notification of First Office Action Issued Against Chinese Application No. 2005800109516; Jan. 4, 2008; 5 pages; China.
XP-002486412; C:/EPOPROGS\SEA\.\.\.\epodata\sea\eplogf\sa799343.log; Jan. 7, 2008; 1 page.
XP-002486413; C:\EPOROGS\SEA\.\.\.\epodata\sea\eplogf\sa799343.log; Jan. 7, 2008; 1 page.
XP-002486414; C:\EPOPROGS\SEA\.\.\.\epodata\sea\eplogf\sa799343.log; Jan. 7, 2008; 1 page.
XP-002486415; C:\EPOPROGS\SEA\.\.\.\epodata\sea\eplogf\sa799343.log; Jan. 7, 2008; 1 page.
Korean Intellectual Property Office; Office Action Issued Against Korean Application No. 2003-7010929; Jan. 14, 2008; 6 pages; Korea (South).
European Patent Office; Supplementary European Search Report Issued in Connection with European Application No. 05713469; Jan. 17, 2008; 2 pages; Europe.
Russian Federation Patent Office; Office Action Issued Against Russian Application No. 2006133381/02; Apr. 1, 2008; 5 pages; Russia.
European Patent Office; European Office Action Issued Against European Application No. 02706344.5; Apr. 2, 2008; 4 pages; Europe.
The Patent Office of the People's Republic of China; Notification of Second Office Action Issued Against Chinese Application No. 2005800109516; Jun. 20, 2008; 4 pages; China.
Patent Cooperation Treaty; PCT International Search Report Issued in Connection with International Applicaiton No. PCT/US2008/060050; Jul. 4, 2008; 4 pages; Europe.
Patent Coopertaion Treaty; PCT Written Opinion of the International Searching Authority Issued in Connection with International Application No. PCT/ US2008/060050; Jul. 4, 2008; 5 pages; Europe.
Patent Cooperation Treaty; PCT International Search Report Issued in Connection with International Application No. PCT/US2008/060060; Jul. 18, 2008; 5 pages; Europe.

Patent Cooperation Treaty; PCT Written Opinion of the International Searching Authority Issued in Connection with International Application No. PCT/US2008/060060; Jul. 18, 2008; 9 pages; Europe.
U.S. Patent and Trademark Office; Office Action Issued Against U.S. Appl. No. 11/549,408; Jul. 24, 2008; 7 pages; USA.
Canadian Intellectual Property Office; Office Action Issued Against Canadian Application No. 2,557,417; Aug. 14, 2008; 4 pages; Canada.
Japan Patent Office; Notice of Reasons for Refusal Issued Against Japanese Application No. 2006-554150; Oct. 28, 2008; 8 pages; Japan.
Japan Patent Office; Notice of Reasons for Refusal Issued Against Japanese Application No. 2004-530797; Dec. 2, 2008; 4 pages; Japan.
Korean Intellectual Property Office; Notice of Grounds for Refusal Issued Against Korean Application No. 10-2006-7017913; Dec. 13, 2008; 4 pages; Korea (South).
U.S. Patent and Trademark Office; Office Action Issued Against U.S. Appl. No. 11/734,113; Jan. 13, 2009; 7 pages; USA.
Korean Intellectual Property Office; Notice of Final Rejection Issued Against Korean Application No. 10-2006-7017913; Jan. 29, 2009; 3 pages; Korea (South).
Australian Government, IP Australia; Examiner's First Report Issued Against Australian Application No. 2005214348; Apr. 1, 2009; 2 pages; Australia.
U.S. Patent and Trademark Office; Office Action Issued Against U.S. Appl. No. 11/734,121; Apr. 28, 2009; 7 pages; USA.
Korean Intellectual Property Office; Notice of Result of Reexamination Issued in Connection with Korean Application No. 10-2006-7017913; Jun. 24, 2009; 4 pages; Korea (South).
U.S. Patent and Trademark Office; Office Action Issued Against U.S. Appl. No. 11/734,121; Jul. 9, 2009; 8 pages; USA.
U.S. Patent and Trademark Office; Office Action Issued Against U.S. Appl. No. 11/734,113; Sep. 21, 2009; 8 pages; USA.
European Patent Office; European Office Action Issued in Connection with European Application No. 03737080.6; Sep. 25, 2009; 3 pages; Europe.
Metals Knowledge: Problems and Prospect of Al-Mg Alloys Application in Marine Constructions; Oct. 20, 2009; 5 pages.
Intellectual Property Tribunal of Korea; Transmittal of Decision on Trial Issued in Connection with Korean Application No. 2006-7017913; Nov. 4, 2009; 10 pages; Korea (South).
Ali Unal; Declaration Uner 37 C.F.R. § 1.132 of Ali Unal, Field in Connection with U.S. Appl. No. 11/734,113; Dec. 21, 2009; 3 pages.
U.S. Patent and Trademark Office; Office Action Issued Against U.S. Appl. No. 11/734,121; Dec. 23, 2009; 10 pages; USA.
Patent Cooperation Treaty; PCT International Search Report Issued in Connection with International Application No. PCT/US2009/059820; Jan. 21, 2010; 5 pages; USA.
Patent Cooperation Treaty; PCT Written Opinion of the International Searching Authority Issued in Connection with International Application No. PCT/US2009/059820; Jan. 21, 2010; 9 pages; USA.
U.S. Patent and Tradmark Office; Office Action Issued Against U.S. Appl. No. 11/734,113; Feb. 18, 2010; 11 pages; USA.
Patent Cooperation Treaty; PCT International Search Report Issued in Connection with International Application No. PCT/US2009/060887; Feb. 26, 2010; 4 pages; Europe.
Patent Cooperation Treaty; PCT Written Opinion of the International Searching Authority Issued in Connection with International Application No. PCT/US2009/060887; Feb. 26, 2010; 4 pages; Europe.
European Patent Office; European Office Action Issued in Connection with European Application No. 03737080.6; Mar. 9, 2010; 2 pages; Europe.
European Patent Office; European Office Action Issued in Connection with European Application No. 03737080.6; Mar. 22, 2010; 2 pages; Europe.
Russian Federation; Russian Office Action Issued in Connection with Russian Application No. 2009141598/02; Mar. 28, 2010; 10 pages; Russia.
Korean Intellectual Property Office; Notice of Grounds for Refusal Issued Against Korean Application No. 10-2005-7002906; Apr. 23, 2010; 6 pages; Korea (South).
U.S. Patent and Trademark Office; Office Action Issued Against U.S. Appl. No. 12/246,937; Apr. 23, 2010; 6 pages; USA.
U.S. Patent and Trademark Office; Office Action Issued Against U.S. Appl. No. 12/267,303; Apr. 26, 2010; 7 pages; USA.
State Intellectual Property of the People's Republic of China; Notification of the Third Office Action Issued Against Chinese Application No. 200580010951.6; May 19, 2010; 4 pages; China.
U.S. Patent and Trademark Office; Office Action Issued Against U.S. Appl. No. 12/246,937; May 20, 2010; 5 pages; USA.
U.S. Patent and Trademark Office; Office Action Issued Against U.S. Appl. No. 12/267,303; Jun. 4, 2010; 6 pages; USA.
Australian Government, IP Australia; Australian Office Action Issued Against Australian Application No. 2008240265; Jun. 17, 2010; 3 pages; Australia.
Ali Unal, Declaration Under 37 C.F.R. § 1.132 of Ali Unal, Filed in Connection with U.S. Appl. No. 11/734,113; Jun. 28, 2010; 7 pages.
European Patent Office; European Office Action Issued Against European Application No. 08799790.4; Jun. 29, 2010; 5 pages; Europe.
U.S. Patent and Trademark Office; Office Action Issued Against U.S. Appl. No. 11/734,113; Aug. 5, 2010; 15 pages; USA.
Intergranual Corrosion and SCC Properties of Al-Mg-Si Alloy Sheets; http://sciencelinks.jp/j-east/article/200311/000020031103A0295070.php; Printed Sep. 2, 2010; 1 page; Japan.
U.S. Patent and Trademark Office; Office Action Issued Against U.S. Appl. No. 12/246,937; Sep. 24, 2010; 6 pages; USA.
State Intellectual Property Office of the People's Republic of China; Office Action Issued Against Chinese Application for Utility Model No. 200920291302.3; Sep. 29,2010; 3 pages; China.
Korean Intellectual Property Office; Korean Notification of Final Rejection Issued Against Korean Application No. 10-205-7002906; Oct. 27, 2010; 3 pages; Korea (South).
U.S. Patent and Trademark Office; Final Office Action Issued Against U.S. Appl. No. 12/267,303; Jan. 12, 2011; 8 pages; USA.
Russian Federation; Russian Office Action Issued in Connection with Russian Application No. 2009141589/02; Jan. 12, 2011; 6 page; Russia.
Korean Intellectual Property Office; Notification of Grounds for Refusal Issued Against Korean Application No. 10-2009-7011352; Jan. 16, 2011; 8 pages; Korea (South).
European Patent Office; European Office Action Issued in Connection with European Application No. 08799790.4; Feb. 4, 2011; 5 pages; Europe.
Ali Unal; Declarations Under 37 C.F.R. § 1.132 of Ali Unal, Filed in Connection with U.S. Appl. No. 11/734,113; Feb. 4, 2011; 3 pages.
Ali Unal; Declaration Under 37 C.F.R. § 1.132 of Ali Unal, Filed in Connection with U.S. Appl. No. 12/246,937; Feb. 4, 2011; 7 pages; USA.
Ali Unal; Declaration of Ali Unal Filed in Connection with Korean Application No. 10-2005-7002906; Feb. 21, 2011; 6 pages.
U.S. Patent and Trademark Office; Office Action Issued Against U.S. Appl. No. 11/734,113; Mar. 28, 2011; 12 pages; USA.
Patent Cooperation Treaty; PCT International Perliminary Report on Patentability Issued in Connection with International Applicaiton No. PCT/US2009/ 059820; Apr. 12, 2011; 9 pages; Europe.
U.S. Patent and Trademark Office; Office Action Issued Against U.S. Appl. No. 12/246,937; Apr. 29, 2011; 7 pages; USA.
Korean Intellectual Property Office; Notification of Grounds for Refusal Issued Against Korean Applicaiton No. 10-2011-7004617; May 11, 2011; 3 pages; Korea ( South).
State Intellectual Property Office of the People's Republic of China; Notification of the First Office Action Issued Against Chinese Application No. 200880018281.6; May 25, 2011; 4 pages; China.
U.S. Patent and Trademark Office; Office Action Issued Against U.S. Appl. No. 12/913,999; Jul. 29, 2011; 11 pages; USA.
Russian Federation Patent Office; Formal Official Action Issued Against Russian Application No. 2011122789/20; Aug. 30, 2011; 4 pages; Russia.
U.S. Patent and Trademark Office; Office Action Issued Against U.S. Appl. No. 12/267,303; Aug. 31, 2011; 9 pages; USA.
Korean Intellectual Property Office; Notification of Grounds for Refusal Issued Against Korean Application No. 10-2005-7002906; Oct. 18, 2011; 5 pages; Korea (South).

U.S. Patent and Trademark Office; Office Action Issued Against U.S. Appl. No. 11/734,113; Nov. 2, 2011; 12 pages; USA.
State Intellectual Property Office of the People's Republic of China; Notification of the First Office Action, Issued Against Chinese Application No. 200880018209.3; Dec. 2, 2011; 9 pages; China.
State Intellectual Property Office of the People's Republic of China; Notification of the Second Office Action; Issued Against Chinese Application No. 200880018281.6; Feb. 13, 2012; 9 pages; China.
European Patent Office; Office Action Issued Against European Applicaiton No. 08799790.4; Feb. 20, 2012; 5 pages; Europe.
U.S. Patent and Trademark Office; Non-Final Office Action, Issued Against U.S. Appl. No. 12/913,972; Aug. 10, 2011; 10 pages; U.S.A.
U.S. Patent and Trademark Office; Final Office Action, Issued Against U.S. Appl. No. 12/267,303; Jun. 13, 2012; 7 pages; U.S.A.
Mexican Intellectual Property Office; Office Action Issued Against Application No. PA/a/2006/009461; Jul. 3, 2012; 2 pages; Mexico.
Canadian Intellectual Property Office; Office Action Issued Against Application No. 2,739,484; Jul. 6, 2012; 4 pages; Canada.
State Intellectual Property Office of the People's Republic of China; Notification of First Office Action, Against Application No. Aug. 1, 2012; 15 pgs; China.
European Patent Office; Office Action Issued Against Application No, 08745622.4; Aug. 17, 2012; 5 pages; Europe.
U.S. Patent and Trademark Office; Non-Final Office Action issued Against U.S. Appl. No. 11/734,113; Oct. 17, 2012; 8 pages; U.S.A.

* cited by examiner

FUNCTIONALLY GRADED MMC STRIP - METALLIC OUTER LAYERS FOR GOOD FORMABILITY, MMC CENTER FOR IMPROVED RIGIDITY (Al-15 VOLUME % $Al_2O_3$ COMPOSITE IN ROLLED CONDITION AT 0.2 mm THICKNESS)

FUNCTIONALLY GRADED METAL MATRIX COMPOSITE SHEET

CROSS-REFRENCE TO RELATED APPLICATION

This is a divisional patent application of U.S. patent application Ser. No. 11/734,121, now U.S. Pat. No. 7,846,554, filed on Apr. 11, 2007.

FIELD OF THE INVENTION

This invention relates to aluminum based Metal Matrix Composites. More particularly, this invention relates to a functionally graded Metal Matrix Composite sheet comprising a central layer having a high density of particulates and a method of making such a sheet. The invention can be practiced in accordance with the apparatus disclosed in commonly owned U.S. Pat. Nos. 5,514,228, 6,672,368 and 6,880,617.

BACKGROUND OF THE INVENTION

Metal Matrix Composites (MMC) combine the properties of a metal matrix with reinforcing particulates thereby enhancing the mechanical properties of the end product. For example, an aluminum based MMC product will typically exhibit an increase in elastic modulus, lower coefficient of thermal expansion, greater resistance to wear, improvement in rupture stress, and in some instances, an increase in resistance to thermal fatigue.

Existing methods of fabricating MMC include squeeze casting, squeeze infiltration, spray deposition, slurry casting, and powder processing. The goal of these fabricating methods is to produce a uniform distribution of particulates throughout a metal matrix or to distribute the particulates near the outer surfaces of the metal product. For example, U.S. Pat. No. 4,330,027 describes a method of embedding particulate matter on the outer surface of a metal strip by forming a solidification front that pushes the particulate matter to the surface of the strip. In the past, however, fabrication of cast MMC into a finished product by rolling, forging, or extrusion has been impeded by the high loading characteristics of the particulate phase.

A need may exist for an aluminum based Metal Matrix Composite that combines the enhanced mechanical properties of MMC with improved ductility, appearance, and ease of fabrication. The present disclosure responds to this need by providing a functionally graded MMC with enhanced characteristics, comprising a central layer having a high density of particulates sandwiched between two outer metallic layers, and a method of manufacturing such a sheet.

SUMMARY OF THE INVENTION

In an illustrative embodiment, the present disclosure provides a method of making a functionally graded MMC sheet having a central layer of particulate matter. The method may include providing molten metal containing particulate matter to a pair of advancing casting surfaces. The molten metal may then solidified while being advanced between the advancing casting surfaces to form a composite comprising a first solid outer layer, a second solid outer layer, and a semi-solid central layer having a higher concentration of particulate matter than either of the outer layers.

The central layer may be then solidified to form a solid composite metal product comprised of an inner layer sandwiched between the two outer layers and the metal product is withdrawn from between the casting surfaces. After withdrawing the product from between the casting surfaces, the product may be subjected to one or more hot rolling or cold rolling passes.

The casting surfaces may be the surfaces of a roll or a belt with a nip defined therebetween. Preferably, the metal product exits the nip at a speed ranging from about 50-300 fpm. In practice, the molten metal can be an aluminum alloy and the particulate matter can be an aluminum oxide for example. As described earlier, the metal product resulting from the method of the present invention comprises two outer layers and an inner layer with a high concentration of particulate matter. For example, for an aluminum based MMC, the inner layer could be comprised of approximately 70% aluminum oxide particles by volume. The product of the present invention can be a strip, a sheet, or a panel having a thickness ranging from about 0.004 inches to about 0.25 inches and is a metal matrix composite that combines the advantages of an MMC with enhancements in ductility, appearance, and ease of fabrication.

The product of the present invention is suitable for use in structural applications such as panels used in the aerospace, automotive, and building and construction industries.

DETAILED DESCRIPTION OF PREFERRED EMBODIMENTS

Figure 1:
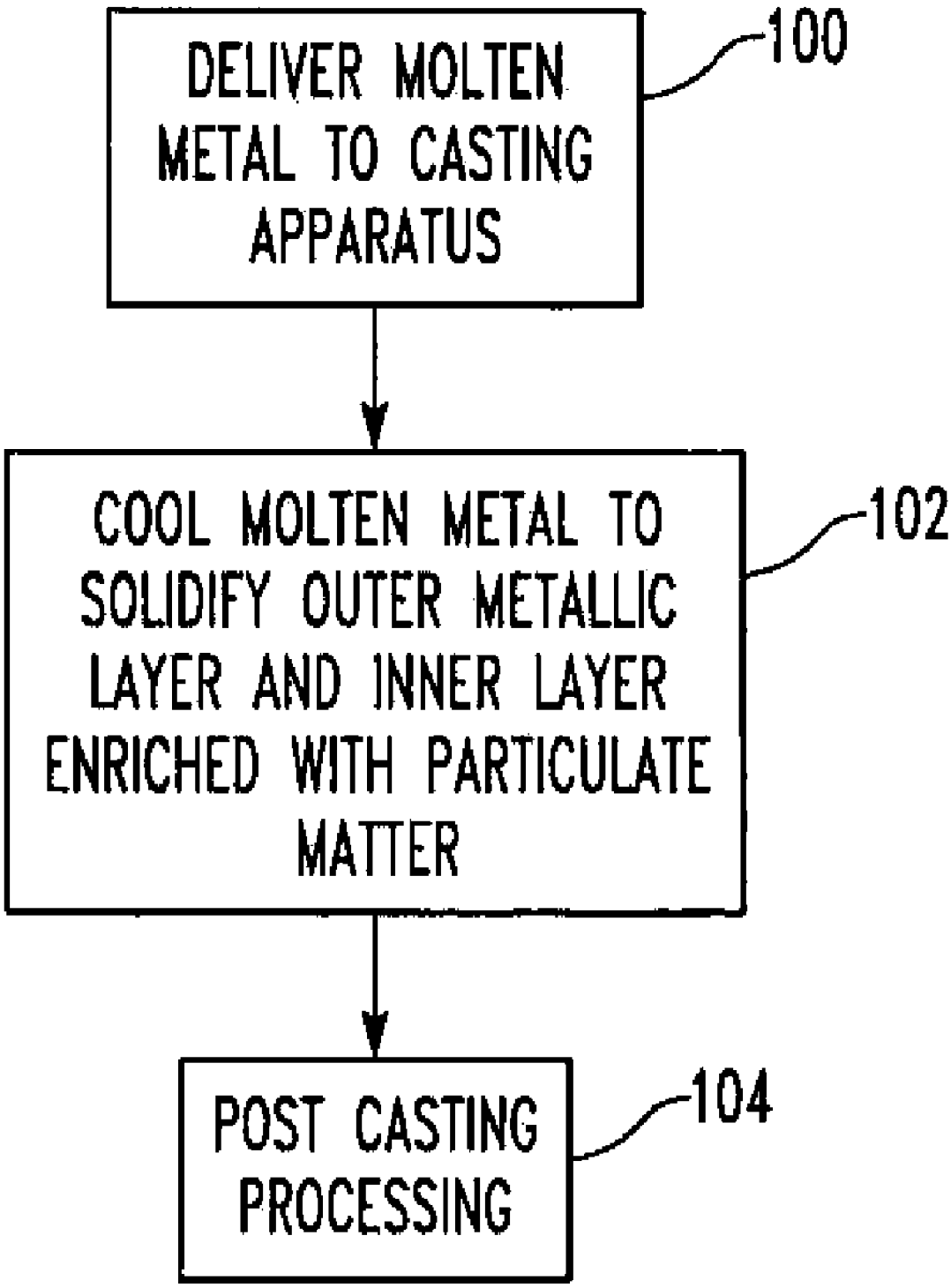
FIG. 1 is a flow-chart describing the method of the present invention.

The accompanying drawings and the description which follows set forth this invention in its preferred embodiments. It is contemplated, however, that persons generally familiar with casting processes will be able to apply the novel characteristics of the structures and methods illustrated and described herein in other contexts by modification of certain details. Accordingly, the drawings and description are not to be taken as restrictive on the scope of this invention, but are to be understood as broad and general teachings. When referring to any numerical range of values, such ranges are understood to include each and every number and/or fraction between the stated range minimum and maximum.

Finally, for purposes of the description hereinafter, the terms "upper", "lower", "right", "left", "vertical", "horizontal", "top", "bottom", and derivatives thereof shall relate to the invention, as it is oriented in the drawing figures. The phrases "aluminum alloys", "magnesium alloys" and "titanium alloys" are intended to mean alloys containing at least 50% by weight of the stated element and at least one modifier element. Aluminum, magnesium, and titanium alloys are considered attractive candidates for structural use in aerospace and automotive industries because of their light weight, high strength to weight ratio, and high specific stiffness at both room and elevated temperatures. The present invention may be practiced with all Aluminum Alloys.

The invention in its most basic form is depicted schematically in the flow chart of FIG. 1. As is depicted therein, in step 100, molten metal containing particulate matter is delivered to a casting apparatus. The casting apparatus includes a pair of spaced apart advancing casting surfaces as described in detail below. In step 102, the casting apparatus rapidly cools at least a portion of the molten metal to solidify an outer layer of the molten metal and inner layer enriched with particulate matter. The solidified outer layer increases in thickness as the alloy is cast.

The product exiting the casting apparatus includes the solid inner layer formed in step 102 containing the particulate matter sandwiched within the outer solid layers of the molten metal. The product can be generated in various forms such as but not limited to a sheet, a plate, a slab, or a foil. In extrusion casting, the product may be in the form of a wire, rod, bar or other extrusion. In either case, the product may be further processed and/or treated in step 104. It should be noted that the order of steps 100-104 are not fixed in the method of the present invention and may occur sequentially or some of the steps may occur simultaneously.

In the present invention, the rate at which the molten metal is cooled is selected to achieve rapid solidification of the outer layers of the metal. For aluminum alloys and other metallic alloys, cooling of the outer layers of metal may occur at a rate of at least about 1000 degrees centigrade per second. Suitable casting apparatuses that may be used with the disclosed invention include, but shall not be limited to cooled casting surfaces such as can be found in a twin roll caster, a belt caster, a slab caster, or a block caster. Vertical roll casters may also be used in the present invention. In a continuous caster, the casting surfaces are generally spaced apart and have a region at which the distance therebetween is at a minimum.

In a roll caster, the region of minimum distance between casting surfaces is known as a nip. In a belt caster, the region of minimum distance between casting surfaces of the belts may be a nip between the entrance pulleys of the caster. As is described in more detail below, operation of a casting apparatus in the regime of the present invention involves solidification of the metal at the location of minimum distance between the casting surfaces. While the method of present invention is described below as being performed using a twin roll caster, this is not meant to be limiting. Other continuous casting surfaces may be used to practice the invention.

Figure 2:
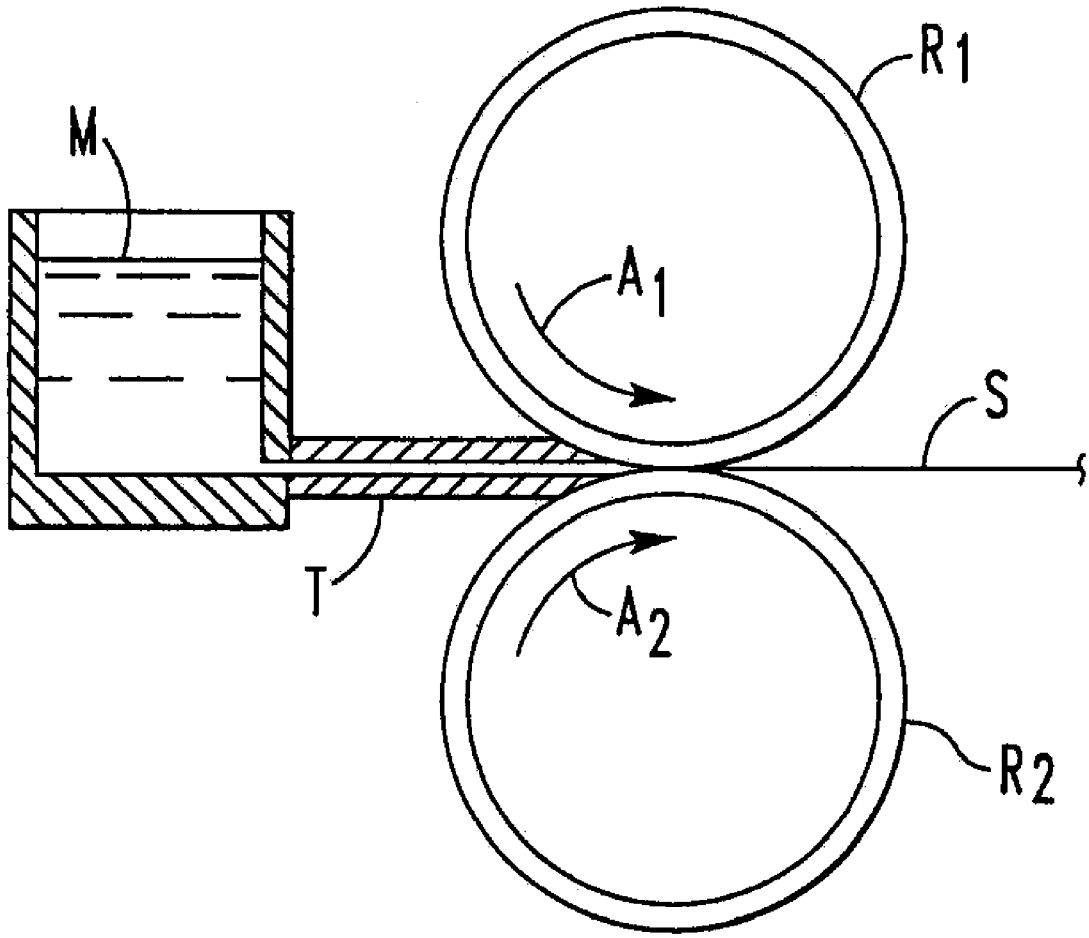
FIG. 2 is a schematic depicting a type of apparatus used in the method of the present invention.
Figure 3:
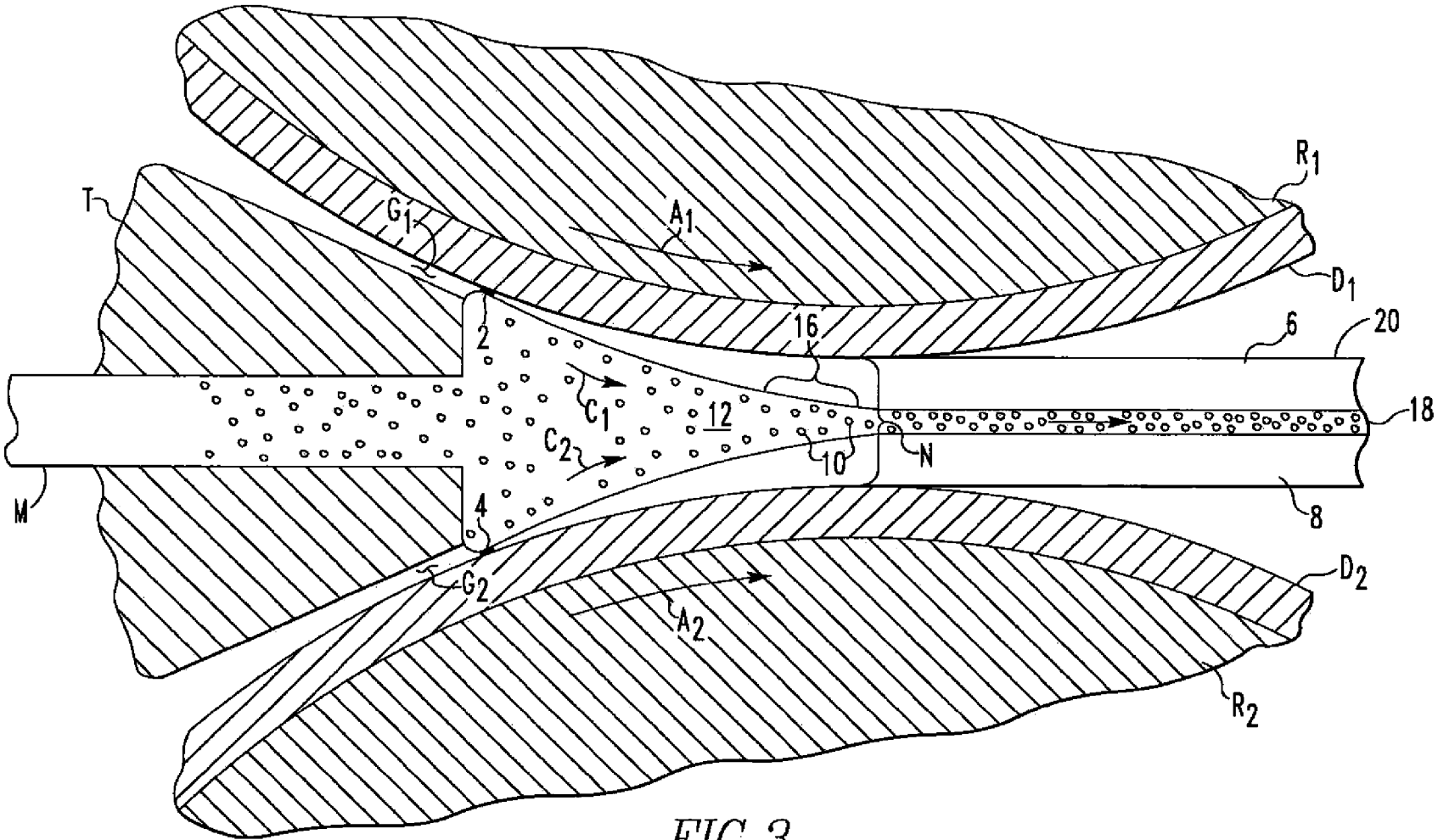
FIG. 3 is an enlarged cross-sectional schematic detailing apparatus operated in accordance with the present invention.

By way of example, a roll caster (FIG. 2) may be operated to practice the present invention as shown in detail in FIG. 3. Referring now to FIG. 2 (which generically depicts horizontal continuous casting according to the prior art and according to the present invention), the present invention can be practiced using a pair of counter-rotating cooled rolls $R_1$ and $R_2$ rotating in the directions of the arrows $A_1$ and $A_2$, respectively. A Roll Caster in conventional use operates at slow speeds and does not produce a functionally graded product. As shown in more detail in FIG. 3, in the practice of the present invention, a feed tip T, which may be made from a refractory or other ceramic material, distributes molten metal M directly onto the rolls $R_1$ and $R_2$ rotating in the direction of the arrows $A_1$ and $A_2$, respectively. Gaps $G_1$ and $G_2$ between the feed tip T and the respective rolls $R_1$ and $R_2$ are maintained as small as possible to prevent molten metal from leaking out and to minimize the exposure of the molten metal to the atmosphere along the rolls $R_1$ and $R_2$ while avoiding contact between the tip T and the rolls $R_1$ and $R_2$. A suitable dimension of the gaps $G_1$ and $G_2$ is about 0.01 inch. A plane through the centerline of the rolls $R_1$ and $R_2$ passes through a region of minimum clearance between the rolls $R_1$ and $R_2$ referred to as the roll nip N.

As can be seen from FIG. 3, in this invention molten metal M containing particulate matter 10 is provided between rolls $R_1$ and $R_2$ of the roll caster. One skilled in the art would understand that the rolls $R_1$ and $R_2$ are the casting surfaces of the roll caster. Typically, $R_1$ and $R_2$ are cooled to aid in the solidification of the molten metal M, which directly contacts the rolls $R_1$ and $R_2$ at regions 2 and 4, respectively. Upon contact with the rolls $R_1$ and $R_2$, the metal M begins to cool and solidify. The cooling metal develops outer layers of solidified metal, i.e. first and second shells 6 and 8 near or adjacent the cooled casting surfaces $R_1$, $R_2$.

The thickness of each of the shells 8 and 6 increases as the metal M advances towards the nip N. Initially, the particulate matter 10 is located at the interfaces between each of the first and second shells 8 and 6 and the molten metal M. As the molten metal M travels between the opposing surfaces of the cooled rolls $R_1$, $R_2$, the particulate matter 10 is dragged into a center portion 12 of the slower moving flow of the molten metal M and is carried in the direction of arrows $C_1$ and $C_2$. In the central portion 12 upstream of the nip N referred to as region 16, the metal M is semi-solid and includes a particulate matter 10 component and a molten metal M component. The molten metal M in the region 16 has a mushy consistency due in part to the dispersion of the particulate matter 10 therein.

The forward rotation of the rolls. $R_1$ and $R_2$ at the nip N advances substantially only the solid portion of the metal, i.e. the first and second shells 6 and 8 and the particulate matter in the central portion 12 while forcing molten metal M in the central portion 12 upstream from the nip N such that the metal is substantially solid as it leaves the point of the nip N. Downstream of the nip N, the central portion 12 is a solid central layer 18 containing particulate matter 10 sandwiched between the first shell 6 and the second shell 8.

Figure 4:
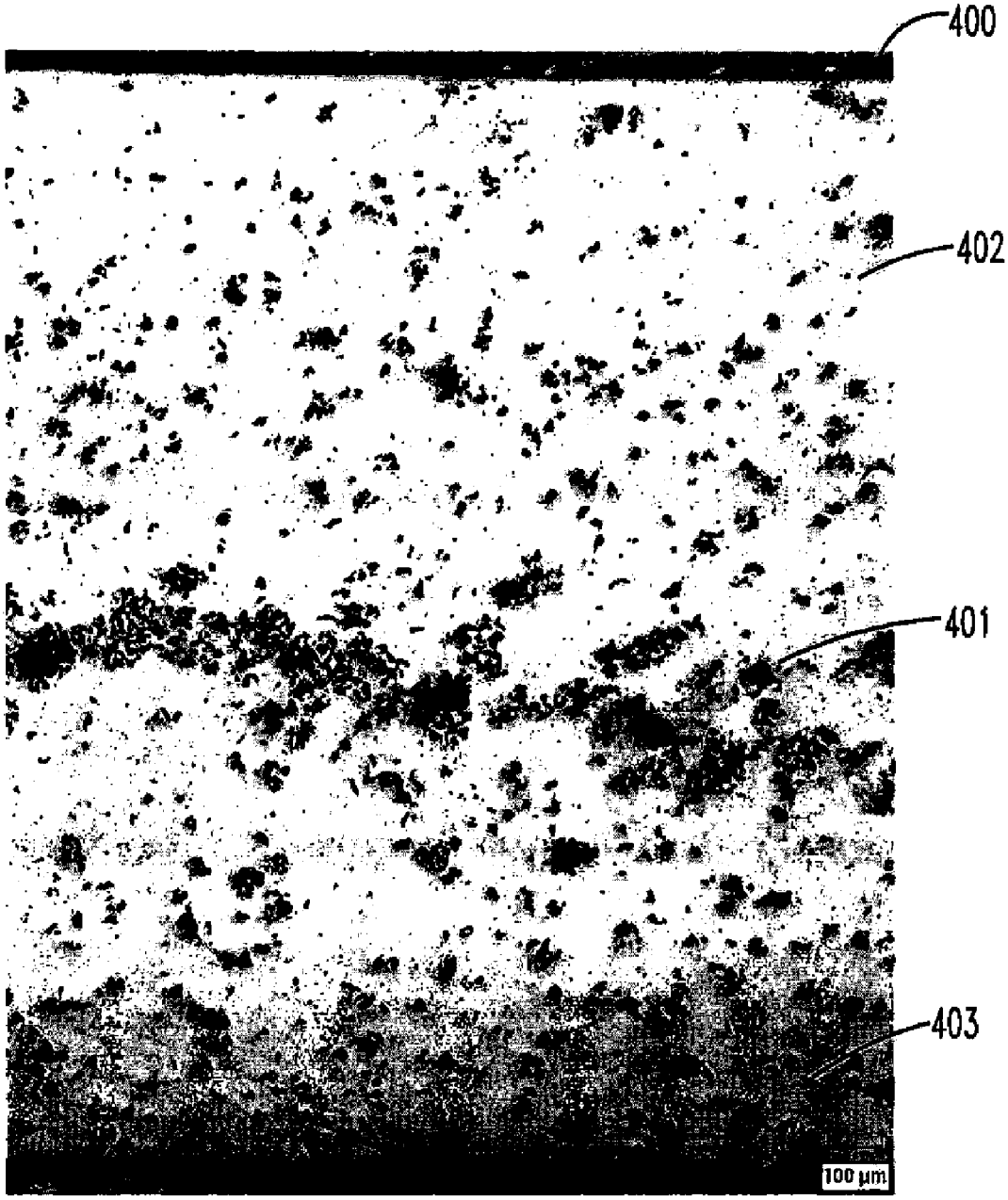
FIG. 4 is a photomicrograph of a transverse section of a strip produced in accordance with the present invention.

For clarity, the three layered aluminum article described above having a central portion 12 with a high concentration of particulate matter 10 sandwiched between the first and second shells 6 and 8 shall also be referred to as a functionally graded MMC structure. The size of the particulate matter 10 in the central layer 18 is at least about 30 microns. In a strip product, the solid inner portion may constitute about 20 to about 30 percent of the total thickness of the strip. While the caster of FIG. 4 is shown as producing strip S in a generally horizontal orientation, this is not meant to be limiting as the strip S may exit the caster at an angle or vertically.

The casting process described in relation to FIG. 3 follows the method steps outlined above in FIG. 1. Molten metal delivered in step 100 to the roll caster begins to cool and solidify in step 102. The cooling metal develops outer layers of solidified metal, i.e. first and second shells 6 and 10, near or adjacent the cooled casting surfaces $R_1$, $R_2$. As stated in the preceding paragraphs, the thickness of the first shell 6 and the second shell 8 increases as the metal advances through the casting apparatus. Per step 102, the particulate matter 10 is drawn into the inner layer 12, which is partially surrounded by the solidified outer layers 6 and 8. In FIG. 3, the first and second shells 6 and 8 substantially surround the inner layer 12.

In other words, the inner layer 12 that contains the particulate matter 10 is located between the first shell 6 and the second shell 8. Said differently, the inner layer 12 is sandwiched between the first shell 6 and the second shell 8. In other casting apparatuses, the first and/or second shells may completely surround the inner layer. Referring to FIG. 1, in step 104, the inner layer is solidified. Prior to complete solidification of the metal, the inner layer of the metal is semi-solid and includes a particulate matter component and a molten metal component. The metal at this stage has a mushy consistency due in part to the dispersion of particulate matter therein.

In step 104, the product is completely solidified and includes an inner layer that contains the particulate matter and a first and second shell, i.e. outer layer, that substantially surrounds the inner layer. The thickness of the inner portion may be about 10-40% of the thickness of the product. In a preferred embodiment, the inner portion is comprised of about 70% particulate matter 10 by volume, while the first and second shells are comprised of about 10% particulate matter 10 by volume. Accordingly, the highest concentration of MMC are in the inner portion, while the outer shells have a low concentration of MMC.

Movement of the particulate matter 10 having a size of at least about 30 microns into the inner layer in step 104 is caused by the shear forces that result from the speed differences between the inner layer of molten metal and the solidified outer layers. In order to achieve this movement into the inner layer, the roll casters would need to be be operated at speeds of at least about 50 feet per minute. Roll casters operated at conventional speeds of less than 10 feet per minute do not generate the shear forces required to move the particulate matter having a size of about 30 microns or greater into the inner layer.

An important aspect of the present invention is the movement of particulate matter having a size of at least about 30 microns into the inner layer.

The functionally graded MMC structure disclosed in this invention combines the benefits of a MMC (e.g. improved mechanical properties) with the ductility and appearance of metallic outer layers. The casting surfaces used in the practice of the invention serve as heat sinks for the heat of the molten metal M. In operation, heat is transferred from the molten metal to the cooled casting surface in a uniform manner to ensure uniformity in the surface of the cast product. The cooled casting surfaces may be made from steel or copper or some other suitable material and may be textured to include surface irregularities which contact the molten metal. The casting surfaces can also be coated by another metal such as nickel or chrome for example or a non-metal.

The surface irregularities may serve to increase the heat transfer from the surfaces of the cooled casting surfaces. Imposition of a controlled degree of non-uniformity in the surfaces of the cooled casting surfaces results in more uniform heat transfer across the surfaces thereof. The surface irregularities may be in the form of grooves, dimples, knurls or other structures and may be spaced apart in a regular pattern. In a roll caster operated in the regime of the present invention, the control, maintenance and selection of the appropriate speed of the rolls $R_1$ and $R_2$ may impact the operability of the present invention. The roll speed determines the speed that the molten metal M advances towards the nip N. If the speed is too slow, the particulate matter 10 will not experience sufficient forces to become entrained in the central portion 12 of the metal product. Accordingly, the present invention is suited for operation at speeds greater than 50 feet per minute.

In the preferred embodiment, the present invention is operated at speeds ranging from 50-300 fpm. The linear speed that molten aluminum is delivered to the rolls $R_1$ and $R_2$ may be less than the speed of the rolls $R_1$ and $R_2$ or about one quarter of the roll speed. High-speed continuous casting according to the present invention is achievable in part because the textured surfaces $D_1$ and $D_2$ ensure uniform heat transfer from the molten metal M and as is discussed below, the roll separating force is another important parameter in practicing the present invention.

A significant benefit of the present invention is that solid strip is not produced until the metal reaches the nip N. The thickness is determined by the dimension of the nip N between the rolls $R_1$ and $R_2$. The roll separating force is sufficiently great to squeeze molten metal upstream and away from the nip N. Were this not the case, excessive molten metal passing through the nip N would cause the layers of the upper and lower shells 6 and 8 and the solid central portion 18 to fall away from each other and become misaligned. Conversely, insufficient molten metal reaching the nip N causes the strip to form prematurely as occurs in conventional roll casting processes. A prematurely formed strip 20 may be deformed by the rolls $R_1$ and $R_2$ and experience centerline segregation.

Suitable roll separating forces range from about 5-1000 lbs per inch of width cast. In general, slower casting speeds may be needed when casting thicker gauge alloys in order to remove the heat from the thick alloy. Unlike conventional roll casting, such slower casting speeds do not result in excessive roll separating forces in the present invention because fully solid non-ferrous strip is not produced upstream of the nip. Alloy strip may be produced at thicknesses of about 0.08 inches to 0.25 inches at casting speeds ranging from 50-300 fpm.

In the preferred embodiment, the molten metal is aluminum or an aluminum alloy. In a second embodiment, the particulate matter can be any non-metallic material such as Aluminum Oxide, Boron Carbide, Silicon Carbide and Boron Nitride or a metallic material created in-situ during casting or added to the molten metal.

Figure 5:
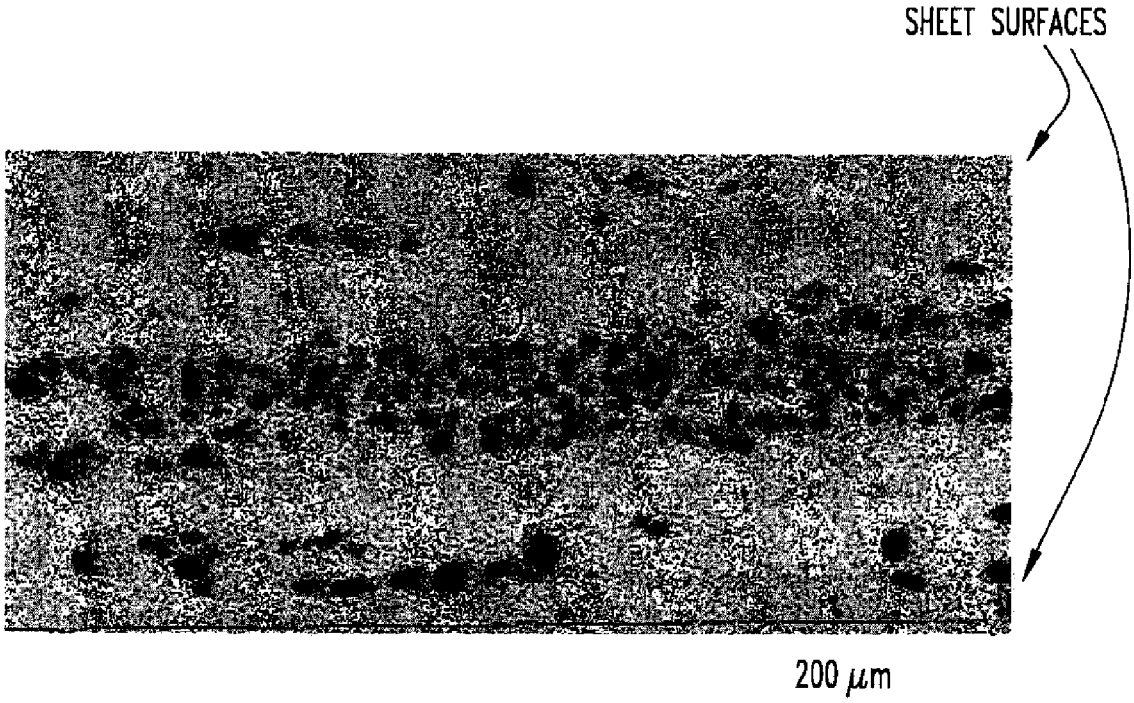
FIG. 5 is a photomicrograph of the transverse section of a strip produced in accordance with the present invention and then hot rolled to a thickness of 0.008 inch thickness

Referring now to FIG. 4, depicted therein is a microstructure of a functionally graded MMC cast in accordance with the present invention. The strip 400 shown comprises 15% alumina by weight and is at 0.004 gauge. The particulate matter 10 can be seen distributed throughout the strip 400 with a higher concentration of particulates concentrated in a central layer 401 while lower concentrations can be seen in outer layers 402 and 403 respectively. It should be noted that there is no reaction between the particulate matter and the aluminum matrix due to the rapid solidification of the molten metal during the process of the present invention. Moreover, in a rolled product in accordance with the present invention there is no damage at the interface between the particulate and the metal matrix as may be seen in FIG. 5. The present invention also allows the production of a cold rolled product without any need to reheat during the cold rolling process. Because the particulate matter does not protrude above the surface of the product it does not wear or abrade the rolling mill rolls.

We claim:

1. A method comprising:

providing a molten metal containing particulate matter to a pair of advancing casting surfaces;

solidifying the molten metal while advancing the molten metal between the advancing casting surfaces to form:

a first solid outer layer, a semi-solid central layer, and a second solid outer layer, wherein the particulate matter is present in each of the first layer, the central layer, and the second layer and wherein the central layer has a higher concentration of particulate matter than either of the first or second outer layers;

solidifying said central layer to form a solid single-cast metal product; and withdrawing the solid single-cast metal product from between the casting surfaces.

2. The method of claim 1, further comprising: hot rolling or cold rolling the solid single-cast metal product.

3. The method of claim 1, wherein a nip is formed between the pair of casting surfaces, and the pair of casting surfaces are surfaces of rolls.

4. The method of claim 1, wherein the product has a thickness ranging from about 0.08 to about 0.25 inches.

5. The method of claim 3, wherein the product exits the nip at a speed ranging from about 50 to about 300 feet per minute.

6. The method of claim 1, wherein one or more hot rolling or cold rolling passes is used to reduce the thickness of the solid metal product to a thickness ranging from about 0.004 inches to about 0.125 inches.

7. The method of claim 1, wherein the molten metal is an aluminum alloy and the particulate matter is selected from the group consisting of aluminum oxide; boron carbide; silicon carbide; boron nitride; and any non-metallic material.

8. The method of claim 1, wherein the solid metal product is selected from the group consisting of a sheet, a strip, and a panel.

9. The method of claim 1, wherein the solid metal product is an aluminum alloy product comprising:

a first shell;

a second shell; and a central layer disposed between the first shell and the second shell;

wherein particulate matter is distributed across the first shell, the central layer, and the second shell in a concentration gradient;

wherein the central layer has a higher concentration of particulate matter than the first shell and the second shell;

wherein the particulate matter is selected from the group consisting of aluminum oxide, boron carbide, silicon carbide, boron nitride and any non- metallic material;

wherein the aluminum alloy product has a thickness ranging from between about 0.004 inches to about 0.25 inches; and wherein the aluminum alloy product is selected from the group consisting of a single-cast aluminum alloy strip, a single-cast aluminum alloy sheet, a single-cast aluminum alloy panel, a single-cast aluminum alloy slab, a single-cast aluminum alloy foil, a single-cast aluminum alloy wire, a single-cast aluminum alloy rod, and a single-cast aluminum alloy bar.

10. The method of claim 1, wherein the particulate matter has a size of at least about 30 microns.

* * * * *